US005915877A

United States Patent [19]

Sargent et al.

[11] Patent Number: 5,915,877

[45] Date of Patent: Jun. 29, 1999

[54] POSITIVE DRIVE BOAT LIFT

[75] Inventors: Charles L. Sargent, Bonita Springs; Daniel S. Carter, Fort Myers, both of Fla.

[73] Assignee: Quality Boat Lift, Inc., Fort Myers, Fla.

[21] Appl. No.: 08/868,792

[22] Filed: Jun. 4, 1997

[51] Int. Cl.[6] ..... B63C 3/06

[52] U.S. Cl. ..... 405/3; 114/44; 187/214

[58] Field of Search ..... 405/3, 1, 7; 114/44–48; 187/214, 209, 210; 254/98, 96

[56] References Cited

U.S. PATENT DOCUMENTS

| | | | |
|---|---|---|---|
| 0,047,501 | 4/1865 | Turner | 114/44 |
| 1,073,294 | 9/1913 | Siewert | 405/198 X |
| 2,091,156 | 8/1937 | Myers | 187/214 |
| 2,262,833 | 11/1941 | Clawson et al. | 187/214 |
| 2,655,223 | 10/1953 | Villars | 187/214 |
| 3,245,658 | 4/1966 | Sutton | 405/198 X |
| 3,276,211 | 10/1966 | Drake | 405/3 |
| 3,537,745 | 11/1970 | Herring | 187/214 X |
| 3,958,664 | 5/1976 | Perkins | 187/214 X |
| 4,195,948 | 4/1980 | Vancil | 405/3 |
| 4,552,403 | 11/1985 | Yindra | 187/214 X |
| 4,678,366 | 7/1987 | Williamson | 405/3 |

FOREIGN PATENT DOCUMENTS

| | | | |
|---|---|---|---|
| 865130 | 1/1953 | Germany | 405/3 |

*Primary Examiner*—Dennis L. Taylor
*Attorney, Agent, or Firm*—William E. Noonan

[57] ABSTRACT

A positive drive boat lift apparatus includes a support structure located proximate a body of water. There is an elongate threaded shaft disposed adjacent to the support structure and extending in a substantially vertical direction. A nut threadably engages the shaft. There is a boat accommodating platform and one of the shaft and the nut are attached to the platform. The other of the shaft and the nut are rotatably mounted to the support structure. The shaft and the nut are rotated relative to one another in a first direction to raise the shaft relative to the nut and in an opposite second direction to lower the shaft relative to the nut, whereby the platform and a boat accommodated thereon are selectively lifted and lowered relative to the body of water.

29 Claims, 11 Drawing Sheets

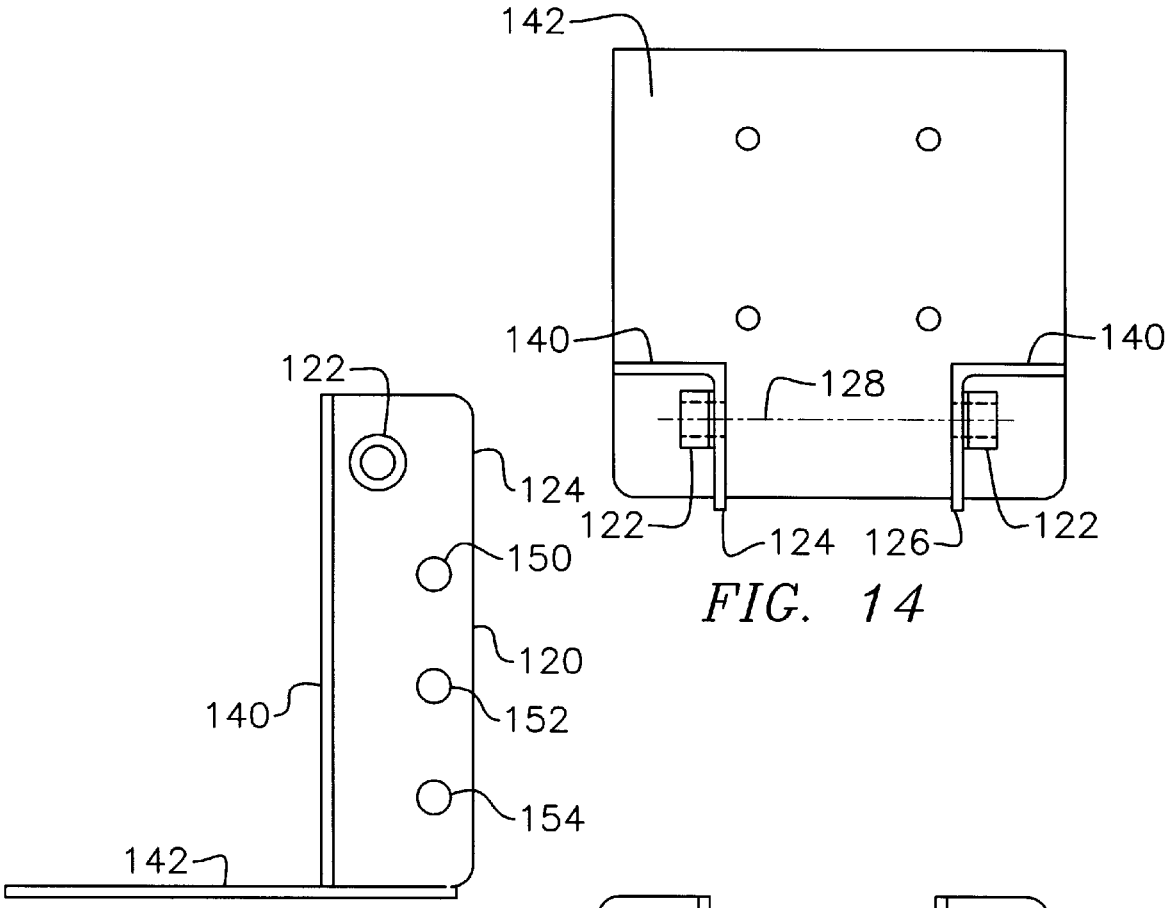
FIG. 14
FIG. 13
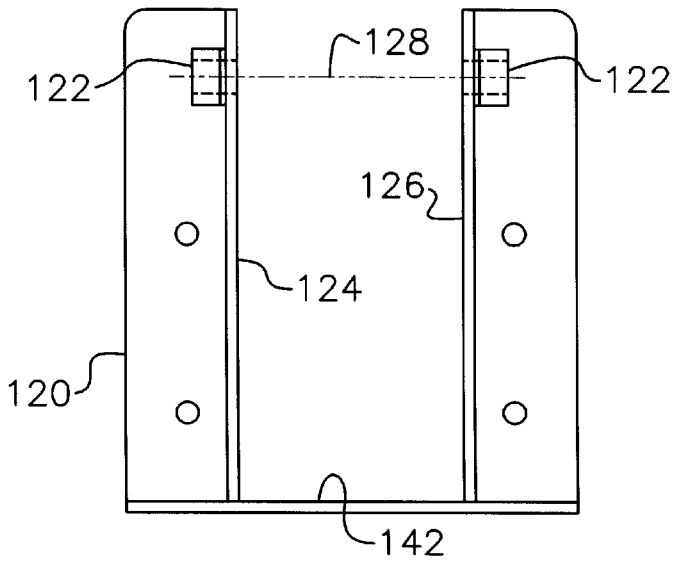
FIG. 15

POSITIVE DRIVE BOAT LIFT

FIELD OF THE INVENTION

This invention relates to a positive drive boat lift and, more particularly, to a boat lift wherein the boat supporting platform is both raised and lowered by a positive drive mechanism.

BACKGROUND OF THE INVENTION

In conventional boat lifts, a boat or other type of watercraft is accommodated on a platform which is typically raised and lowered by a winch and cable mechanism. A wide variety of such lifts are known. However, virtually all exhibit one or more of a number of disadvantages.

The lift platform is usually raised by a motor or hand crank. To return the vessel to the water, the platform is lowered with the assistance of gravity. Most known boat lifts employ either a gear reduction or a separate brake mechanism to slow the descent of the platform. Such mechanisms contribute significantly to the complexity and expense of the boat lift.

Additionally, many standard cable-operated lift platforms experience problems with buoyancy. In order to properly lower the boat into the water, the hull of the vessel must be partially submerged. Most boat lift platforms employ structural components (e.g. cradle beams, bunk boards, etc.) that are composed of buoyant materials such as wood or lightweight aluminum. Consequently, as the lift platform is lowered by gravity it tends to float on the water. This can prevent the hull of the watercraft from being properly submerged. Moreover, when the platform suddenly engages the water and floats, the cables may continue to unwind from the spool of the winch. This can cause the cables to unravel and tangle. Operation of the boat lift may be disrupted and costly, time consuming repairs may be required.

Standard cable driven boat lifts also employ a fairly intricate lifting mechanism. Typically, four sets of cables, pulleys and motors are required to raise and lower the lift platform.

SUMMARY OF INVENTION

It is therefore an object of the present invention to provide a positively driven boat lift apparatus that operates reliably, safely and efficiently in two directions to selectively raise and lower a boat or other type of watercraft into or out of a body of water.

It is a further object of this invention to provide a positively driven boat lift apparatus that lowers a supported boat into a body of water safely and reliably without requiring a separate braking mechanism or complicated reduction means.

It is a further object of this invention to provide a positively driven boat lift apparatus that resists buoyancy and submerges the lift platform sufficiently beneath the water such that the boat supported on the platform may be properly deployed in the water.

It is a further object of this invention to provide a positively driven boat lift apparatus that avoids the problems commonly associated with standard winch and cable lift assemblies, including unraveling and tangling of the cables.

It is a further object of this invention to provide a positively driven boat lift apparatus that overcomes the buoyancy of the lift platform components and the problems associated therewith.

It is a further object of this invention to provide a positively driven boat lift apparatus which is installed and operated in a simple, efficient and inexpensive fashion and that is significantly less complicated than standard cable driven lifts.

It is a further object of this invention to provide a positively driven boat lift apparatus that safely and effectively guides the boat as it is being lifted or lowered and which effectively compensates for mispositioning of the vessel on the lift platform and lack of synchronization between respective lift motors.

It is a further object of this invention to provide a positively driven boat lift apparatus that utilizes standard pilings both to provide supporting strength and to guide the lift platform.

This invention results from a realization that a positively driven boat lift apparatus avoids a number of the problems often associated with standard winch and cable driven boat lifts. Specifically a positively driven boat lift employing a complementary threaded nut and shaft drive mechanism eliminates the difficulties associated with buoyancy and braking, which are frequently exhibited by known lift devices. Such a lift also compensates for mispositioning of the boat on the lift much more simply and efficiently than is done by standard cable lifts.

This invention features a positive drive boat lift apparatus, which includes a support structure located in or adjacent to a body of water. There is an elongate, threaded shaft disposed adjacent to the support structure and extending in a substantially vertical direction. Means define a nut that threadably engages the shaft. Means define a boat accommodating platform. There are means for attaching one of the shaft and the nut to the platform. Means are also provided for rotatably mounting the other of the shaft and the nut to the support structure and selectively driving the shaft and the nut rotatably relative to one another in a first direction to raise the shaft relative to the nut, and in an opposite second direction to lower the shaft relative to the nut. As a result, the platform and the boat accommodated thereon are selectively lifted and lowered relative to the body of the water.

In a preferred embodiment, the means for mounting and driving include a wheel rotatably mounted on the support structure. The nut may be generally surrounded by and mounted axially in the wheel and the means for mounting and driving may further include means for selectively turning the wheel in opposing first and second directions to respectively raise and lower the shaft relative to the wheel. The nut may be defined by a threaded opening formed axially through the wheel.

The means for mounting and driving may include a drive motor and means for operably interengaging the drive motor and the nut. The means for operably interengaging may include reduction means for transferring rotation from the motor to the nut and controlling the rotational speed of the nut. The reduction means may include a pulley assembly. The pulley assembly may include a primary pulley wheel rotatably mounted on the support structure, which wheel surrounds and holds the nut.

The nut is preferably rotatably mounted to the support structure and driven to raise and lower the shaft. Such embodiments may further include tubular guide means mounted to the support structure for accommodating the shaft as the shaft is raised and lowered. The means for attaching may include an elongate element that is interconnected between the shaft and the platform. The elongate element is largely retracted into the tubular guide means when the shaft is raised and extended below the tubular guide means when the shaft is lowered. The elongate element may include an inner tubular member that is received generally telescopically within the tubular guide means. The guide means may include a lower guide tube that is suspended from the support structure and located beneath the nut. The guide means may further include an upper guide tube carried by the support structure and located above the nut. A generally tubular bearing sleeve may be carried by an interior surface of the guide means and slidably interengaged with the tubular member when the tubular member is retracted or extended relative to the guide means.

Preferably, the threaded shaft includes an acme screw thread. The support structure may comprise a piling.

Guide means may be mounted to the platform for interengaging the support structure and constraining the position of the platform relative to the support structure when the platform is lifted and lowered. The guide means may include a side roller assembly arranged axially parallel to the longitudinal axis of the platform and interengagable with a side of the support structure that faces the platform. The guide means may also include spaced apart forward and rearward roller assemblies arranged axially transverse to a longitudinal axis of the platform and interengagable respectively with forward and rearwardly facing surfaces of the support structure.

In certain embodiments a pair of complementary screw and nut mechanisms may be employed on respective sides of the boat. Each such mechanism is interconnected between a respective piling and a respective side of the platform. Such an embodiment achieves improved compensation for mispositioning of the boat on the platform, particularly if forward and rearward guide rollers are also used. It also helps to resist inward cantilevering of the pilings, particularly if the side roller assembly is employed.

BRIEF DESCRIPTION OF THE DRAWINGS

Other objects, features and advantages will occur from the following description of preferred embodiments and the accompanying drawings, in which:

FIGS. 13–15 are side front and top views, respectively, of the platform mounting bracket.

DETAILED DESCRIPTION OF PREFERRED EMBODIMENTS

Figure 1:
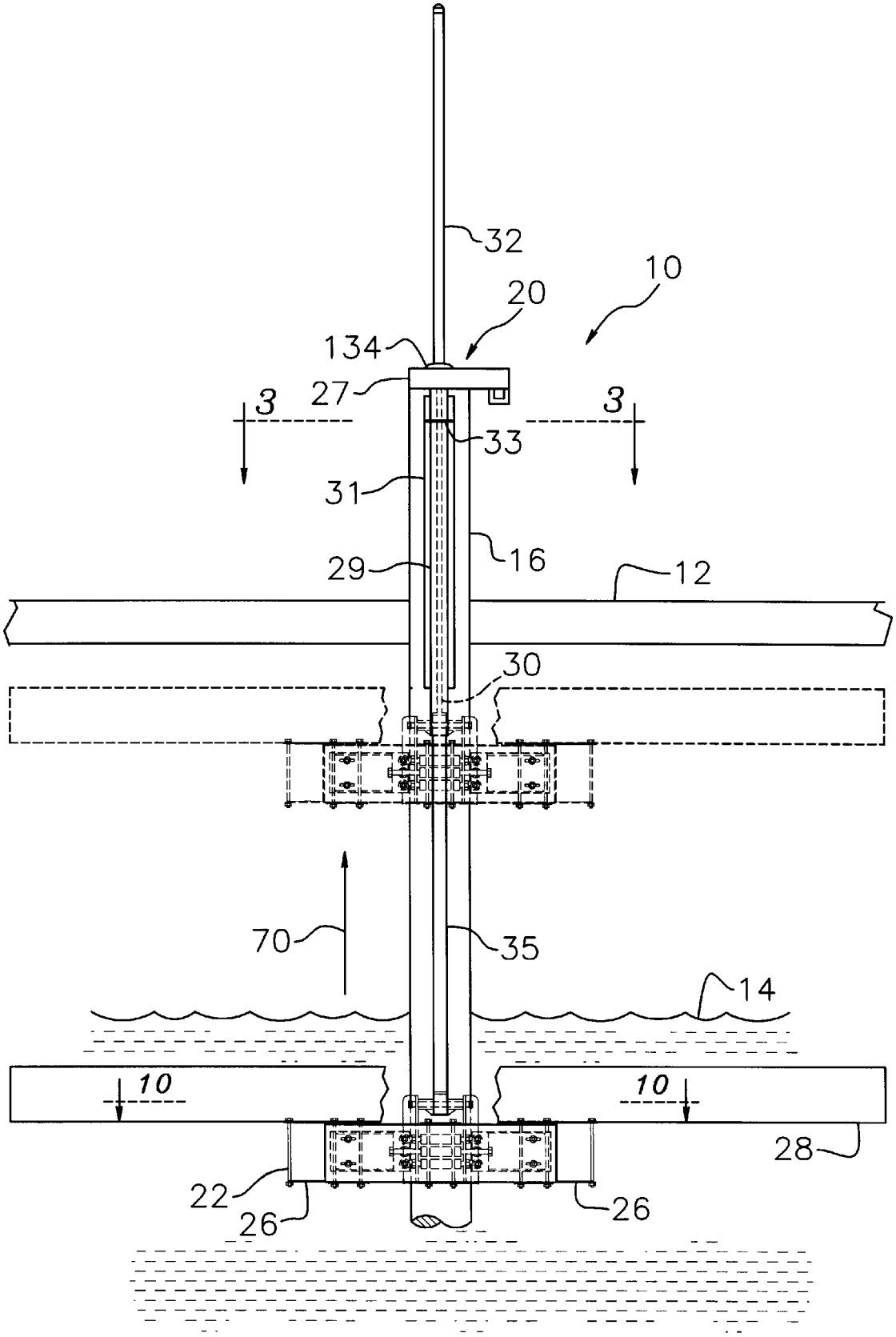
FIG. 1 is a elevational side view of a preferred positive drive boat lift apparatus according to this invention.

There is shown in FIG. 1 a positive drive boat lift apparatus 10. The boat lift is mounted beside a dock or pier 12, which extends into a body of water 14. A vertical support structure 16, which typically comprises a piling, is disposed adjacent dock 12. The piling is disposed in, adjacent to, or otherwise proximate water 14. As used herein, "proximate" means any of the known ways that the piling may be positioned relative to the water. In some cases, a plurality of pilings are utilized to support the dock. In other embodiments, a piling or other support structure 16, which is independent of a dock, may be utilized.

Figure 2:
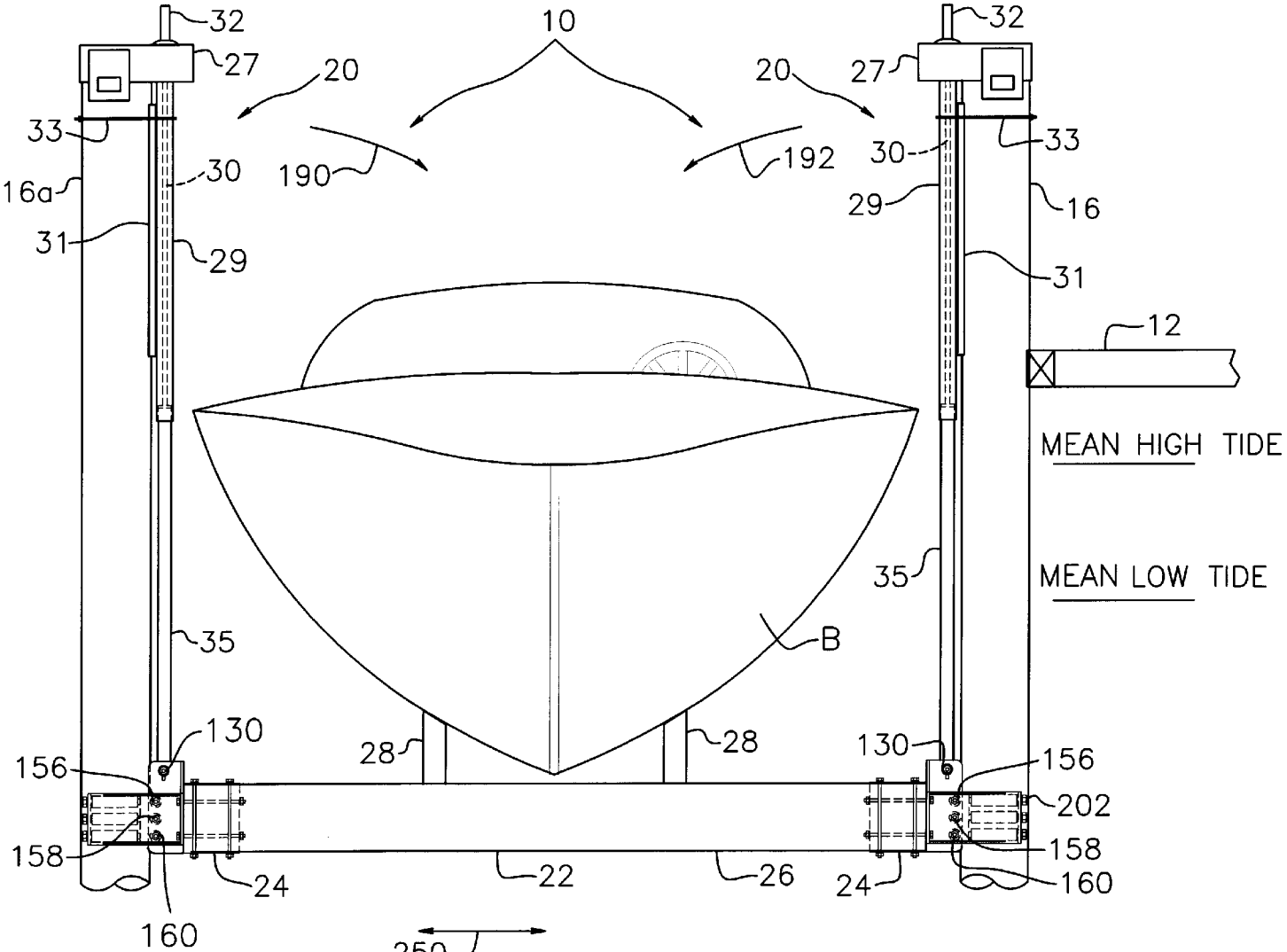
FIG. 2 is an elevational end view of a boat lift apparatus that employs a pair of positive drive assemblies in conjunction with respective longitudinal sides of the lift platform; a boat, illustrated in cross section, is mounted on the lift platform.

Lift 10 features a positive actuator assembly 20. A single positive actuator assembly is illustrated in FIG. 1. As shown in FIG. 2, lift 10 may actually include a pair of positive actuator assemblies 20 that are mounted to respective pilings 16 and 16*a*. A boat lift platform 22 is interconnected to and extends between the lower ends of assemblies 20. Platform 22 comprises a plurality of longitudinal platform beams 24 and transverse cradle beams 26, FIGS. 1 and 2. A pair of bunk boards 28 support a boat B, FIG. 2, in a more or less conventional manner. As with other known boat lifts, the purpose of lift 10 is to selectively raise boat B. Subsequently, the lift is or lowered to deploy the vessel into water 14. The level to which boat B must be raised or lowered is selected according to the particular tide that exists when the lift is operated. It should be noted that, in alternative embodiments, lift 10 may include four or more actuator assemblies 20, with equal numbers of the assemblies located along the port and starboard sides of the vessel. Larger multiples may be employed for use with larger boats. For smaller vessels, such as personal watercraft or small boats, only a single assembly 20 may be needed.

The construction and operation of the boat lift and, more particularly, each assembly 20, will now be described. As shown in FIGS. 1 and 2, a rotatable drive mechanism 27 is secured by bolts, brackets or other standard means of attachment to the upper end of piling 16 (an analogously piling 16*a*). The internal structure and operation of mechanism 27 is described more fully below. An elongate, lower guide tube 29 is attached to and depends vertically from mechanism 27. Each tube 29 is also attached to a bracket 31. The bracket is itself attached to a respective piling 16, 16*a* by a U-bolt 33. As is best shown in the FIG. 3, the U-bolt 33 is wrapped about tube 29 and is secured in place to the piling by nuts 34. The lower end of tube 29 extends slightly below the level of the dock. An elongate upper receiver tube 32 is communicably mounted to a receptacle 134, FIG. 1, of drive mechanism 27. As will be shown more fully below, receiver tube 32 is aligned with lower guide tube 29. The guide tube is suspended from the drive mechanism in a manner analogous to a pendulum. Tube 29 is allowed to flex relative to piling 16, 16*a*. This permits the guide tube to retain a vertical orientation and compensates for movement by the piling. In alternative embodiments, a plurality of U-bolt attachments may be employed.

Figure 3:
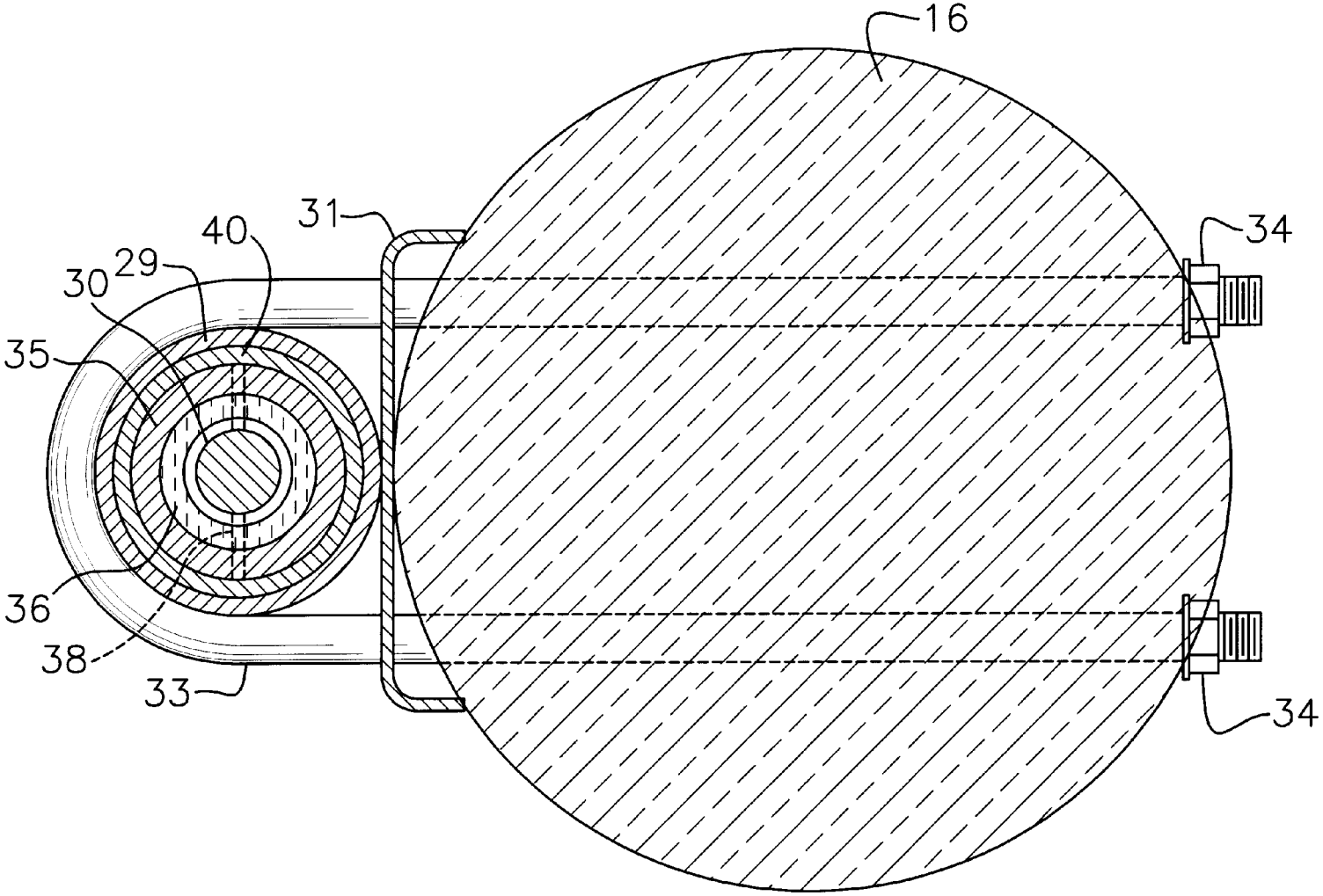
FIG. 3 is a cross sectional view taken along line 3—3 of FIG. 1.

The aligned tubes 29 and 32 on respective sides of drive mechanism 27 movably accommodate a threaded screw shaft 30, FIGS. 1–3. Shaft 30 is supported by the drive mechanism in a manner that is illustrated more fully below. When the drive mechanism is operated according to this invention, shaft 30 is selectively raised and lowered so that it longitudinally moves between lower tube 29 and aligned upper receiver tube 32. Shaft 30 preferably includes an acme thread or some other type of helical screw thread.

The lower end of shaft 30 is secured to the upper end of an elongate inner tube 35 by a collar 36 and a pair of connecting pins 38, one of which is shown in FIG. 3. As a result, when shaft 30 is raised and lowered within aligned tubes 29 and 32, inner tube 35 is respectively retracted within and extended from lower guide tube 29. As best shown in FIGS. 1 and 2, the inner tube is aligned with guide tube 29. As depicted in FIG. 3, an intermediate annular bearing 40 interengages tubes 29 and 35 when the inner tube 35 is retracted within the guide tube 29. As a result, smooth, reliable sliding between the tubes is facilitated. When shaft 30 is lowered, as is described more fully below, inner tube 35 is extended from guide tube 29. Conversely, when shaft 30 is raised, the inner tube is retracted within the guide tube. A generally telescoping operation is thereby exhibited.

Figure 4:
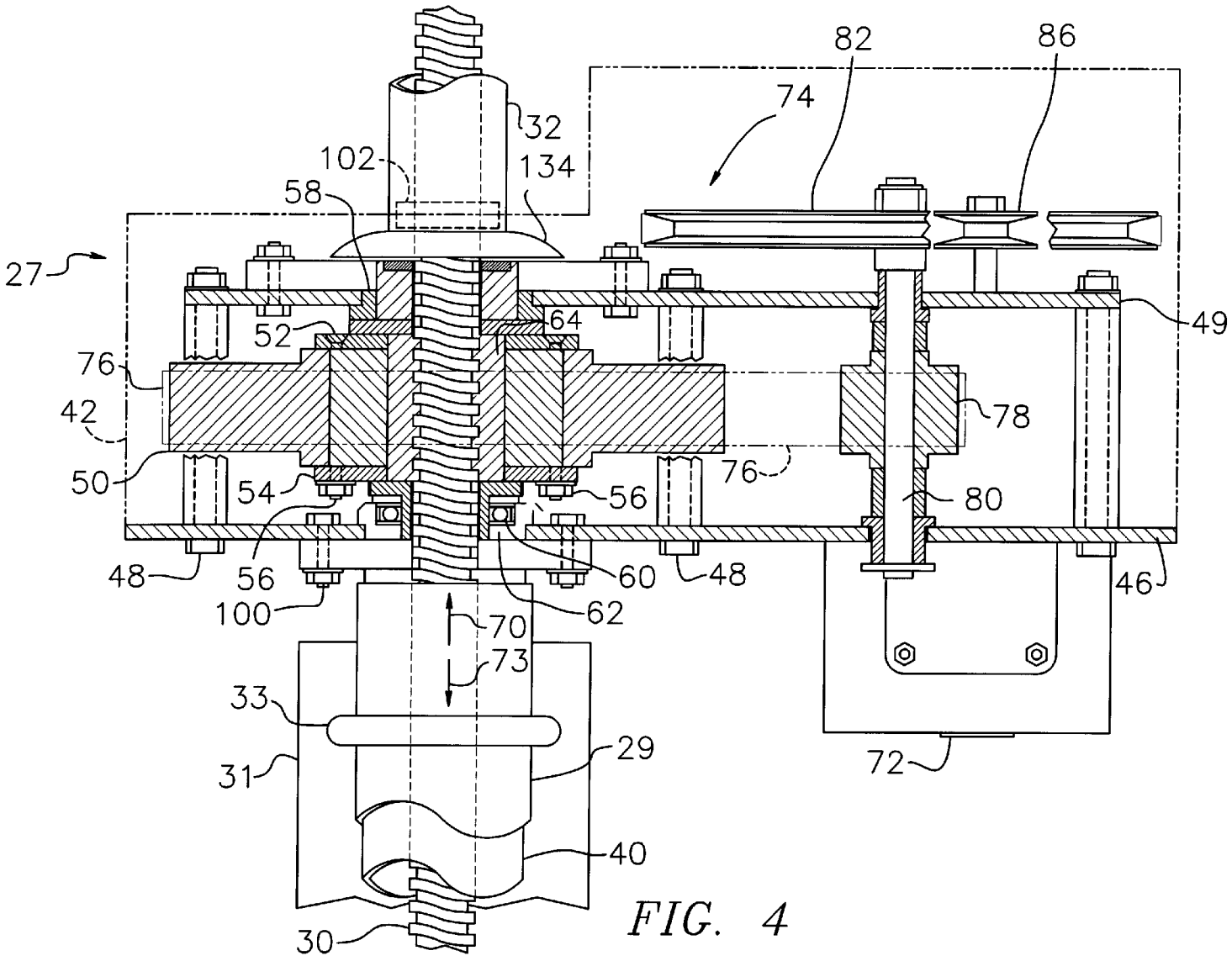
FIG. 4 is an elevational, partly cross sectional view of the complementary threaded shaft and nut, as well as the mechanism for rotatably mounting the nut on the support structure and rotatably driving the nut such that the shaft is selectively raised and lowered.
Figure 5:
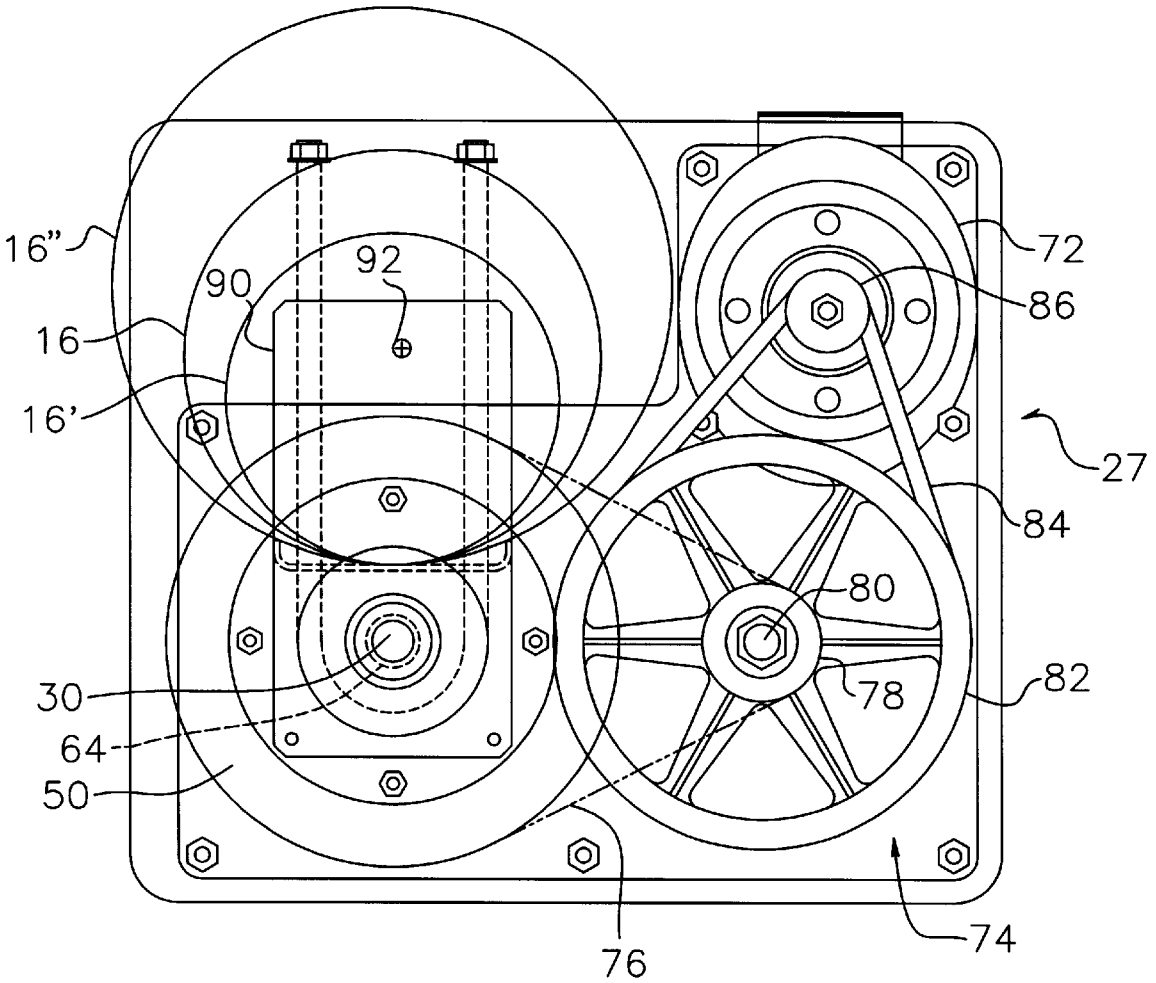
FIG. 5 is a top view of the drive mechanism depicted in FIG. 4.

Drive mechanism 27 is illustrated in detail in FIGS. 4 and 5. The drive mechanism includes a spaced apart pair of upper and lower plates 44 and 46 that are interconnected by spacer bolts 48. A primary pulley wheel 50 is rotatably mounted between plates 44 and 46. Specifically, pulley 50 is positioned between a pair of plates 52 and 54 that are interconnected by spacing bolts 56. In alternative embodiments, the plates 52 and 54 may be integral with wheel 50. Standard bearings or bushings 58 are positioned between plate 52 and upper plate 44. Wheel 50 is seated upon a thrust bearing 60. The thrust bearing is contained in a raceway 62 that is fitted in a corresponding opening in lower plate 46. An optional housing 42 (shown in phantom) may be attached to plate 46.

A threaded nut 64 is formed axially through pulley wheel 50. Nut 64 may be formed unitarily with wheel 50. Alternatively, an axial opening may be formed in the pulley wheel and the nut inserted into that opening. Nut 64 threadably and operably engages shaft 30, which extends axially through wheel 50.

As best illustrated in FIG. 4, lower guide tube 29 is secured to the bottom plate 46 of drive mechanism 27 by bolt attachments 100. Shaft 30 extends through an opening in lower plate 46 and through thrust bearing 60 into threaded interengagement with nut 64. Shaft 60 extends upwardly through upper plate 44 and into receiver tube 32. The receiver tube engages complementary receptacle 134 that is carried by the drive mechanism. Preferably, receiver tube 32 has a larger diameter than the open upper end of receptacle 134. This helps to prevent moisture from entering housing 42 and interfering with operation of the drive mechanism. A bushing or bearing 102 may be formed about the shaft as it enters the receiver tube. This bearing helps to facilitate movement of the screw threaded shaft into and out of the receiver tube. The guide tube is typically constructed of steel. The receiver tube may be constructed of a lightweight, yet durable material, such as PVC plastic. Various corrosion-resistant metals may also be utilized.

Wheel 50 and nut 64 are rotatably driven to raise and lower shaft 30 by a conventional drive motor 72. Motor 72 is secured to housing 42 or some other fixed part of the drive mechanism by standard means of attachment. A reduction apparatus 74 operably interengages motor 72 and nut 64 and controls the speed at which the nut is rotated. In the embodiment shown herein, reduction apparatus 74 comprises a belt and pulley assembly. In particular, the reduction assembly includes primary pulley wheel 50. A timing belt 76 operably connects pulley wheel 50 to a smaller diameter secondary pulley wheel 78, which is in turn connected through an idler shaft 80 to a third pulley wheel 82. The latter wheel is operably interconnected by a V belt 84 to the drive pulley 86 of motor 72.

In operation, relative rotation between the shaft and the nut causes the shaft to move either upwardly or downwardly through the threaded nut, depending upon the direction of the relative rotation. As motor 72 rotates, pulley 86 drives belt 84, which in turn rotates pulley wheel 82. This causes idler shaft 80 and attached pulley wheel 78 to rotate. In turn, wheel 78 drives timing belt 76 and this rotates wheel 50. As a result, nut 64 rotates and threadably interengaged shaft 30 is driven in either an upward or downward direction, which depends upon the direction in which motor 72 is operated. When the nut is rotated in a first direction the shaft is longitudinally raised in the direction of arrow 70 and drawn into receiver tube 32. When the nut is rotated in an opposite direction, the shaft is longitudinally lowered in the direction of arrow 72 and drawn into guide tube 29. The helical thread permits shaft 30 to descend in a controlled manner. Essentially, the shaft itself comprises a part of the reduction means and eliminates the need for a separate braking mechanism.

As shown in FIG. 5, drive mechanism 27 is mounted on top of piling 16. A mounting plate 90 that is carried by mechanism 27 is bolted into the top of the piling at 92. In alternative embodiments, the drive mechanism may be secured to a smaller piling 16' or a larger piling 16". The entire lift substantially hangs from mechanism 27 on the top of the piling. The U-bolt 33 holds the assembly against the piling and at the same time allows for some movement to compensate for movement of the piling. The pilings support the compressive load of the entire lift 10 and the supported boat. Lift 10 thereby takes advantage of the normally significant compressive strength of the pilings.

It should be understood that a wide variety of drive mechanisms may be employed in lift 10. In alternative embodiments, the reduction means may comprise operably interengaged gears and various other means. Moreover, the particular types of bearings and other means for rotatably supporting the reduction means and operably interconnecting those reduction means between the drive motor and the nut may be varied in accordance with this invention.

Figure 6:
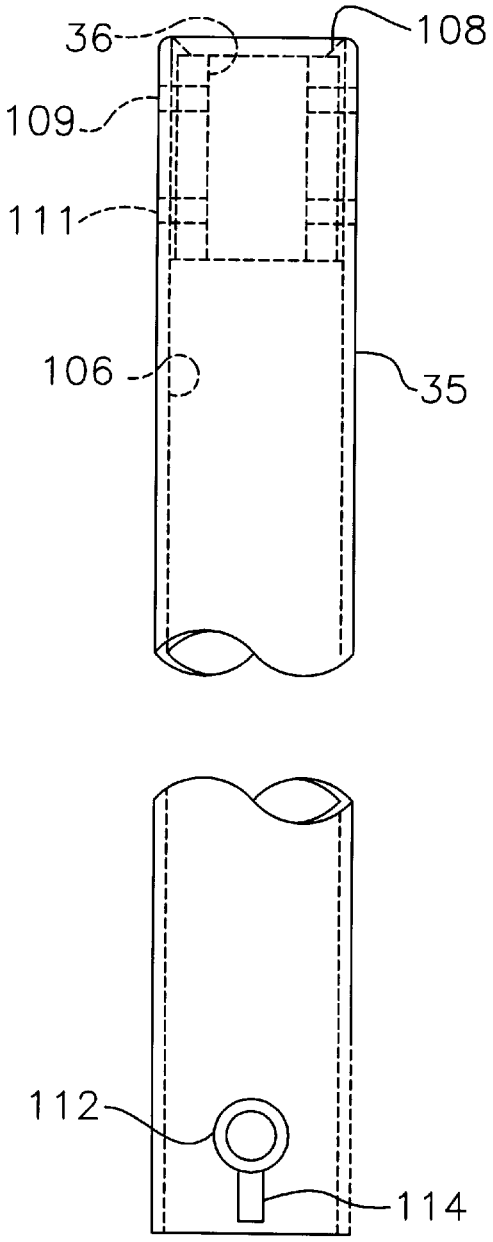
FIG. 6 is an elevational side view of the inner tube.
Figure 7:
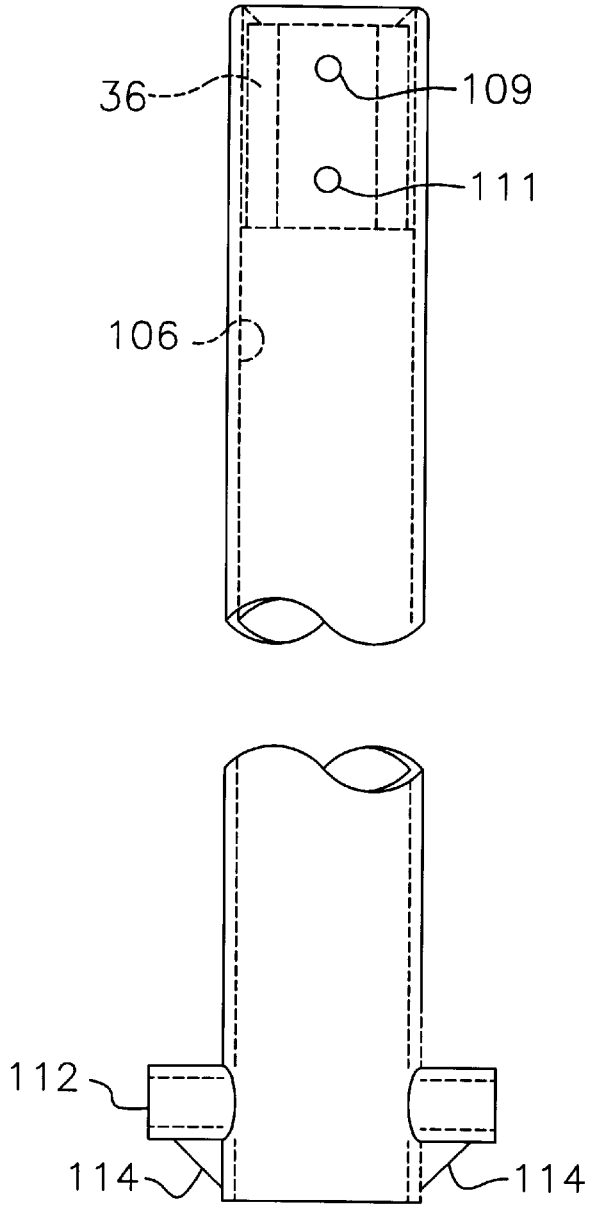
FIG. 7 is an elevational side view of the inner tube taken at 90 degrees to the view illustrated in FIG. 6.
Figure 8:
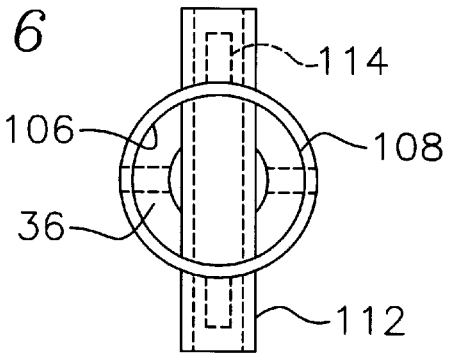
FIG. 8 is a top plan view of the inner tube.

Inner tube 35 is constructed in the manner best illustrated in FIGS. 6–8. The inner tube is composed of steel. Tube 35 includes a central channel 106. The upper end of the inner tube has a beveled or tapered opening 108. Annular collar 36 is fitted and welded at 108 within channel 106 proximate the upper end of the tube. A pair of generally parallel openings 109 and 111 are formed through the side wall of the tube for accommodating connecting pins 38, shown in FIG. 3. Openings 109 and 111 extend fully through the side wall of the inner tube and through the annular collar 36. The lower end of tube 35 carries bushing 112 that is strengthened by gussets 114, FIGS. 6–8.

Figure 9:
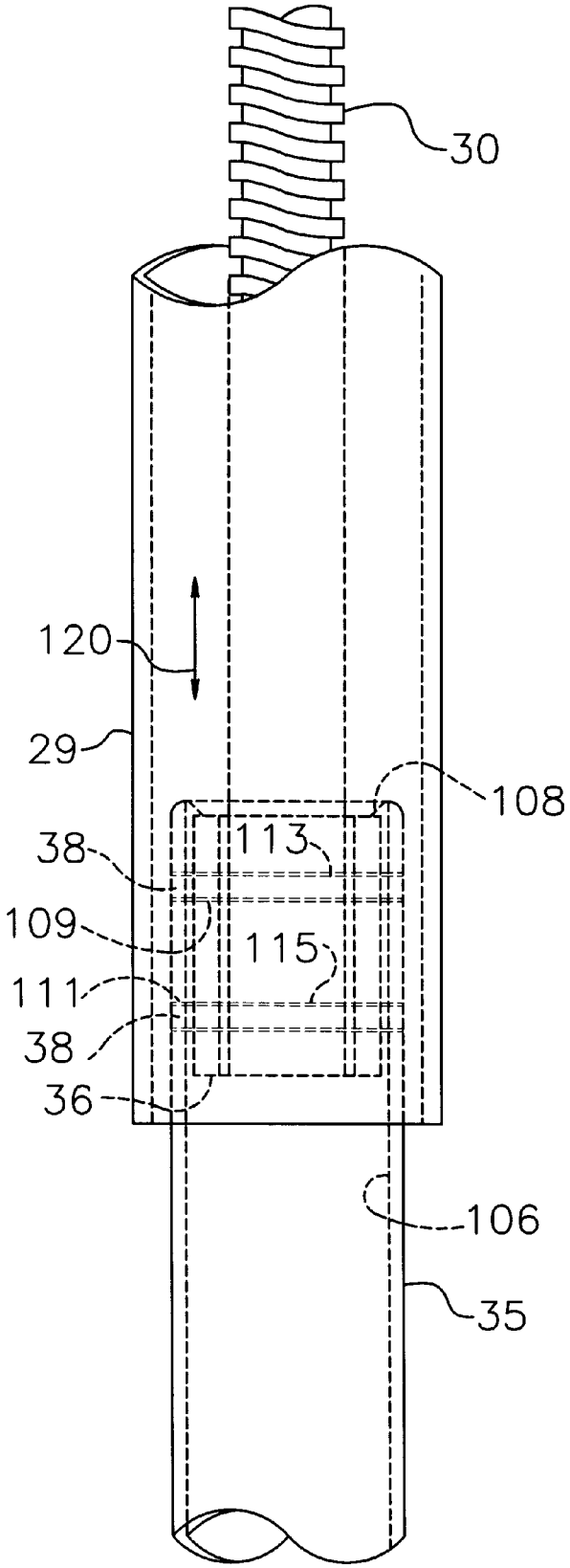
FIG. 9 is an elevational view of the lower end of the shaft as interconnected to the upper end of the inner tube.

The lower end of shaft 30 is secured to the upper end of tube 35 in the manner best shown in FIG. 9. The lower end of the shaft extends into central channel 106. The shaft also extends through the central opening of annular collar 36. The lower end of shaft 30 includes a pair of openings 113, 115 that correspond to the openings 109 and 111, respectively, in tube 35 and collar 36. Appropriate means of attachment such as connecting pins 38 are secured through the aligned openings 109, 113 and 111, 115 so that the shaft 30, collar 36 and inner tube 35 are securely interconnected. As a result, the shaft and inner tube are aligned and, in this condition, these elements are inserted longitudinally through guide tube 29. When the shaft is raised and lowered in the manner indicated by double-headed arrow 120, the shaft 30 and attached inner tube 35 are moved longitudinally through guide tube 29. Annular bearing 40, FIG. 3, facilitates this movement.

Figure 10:
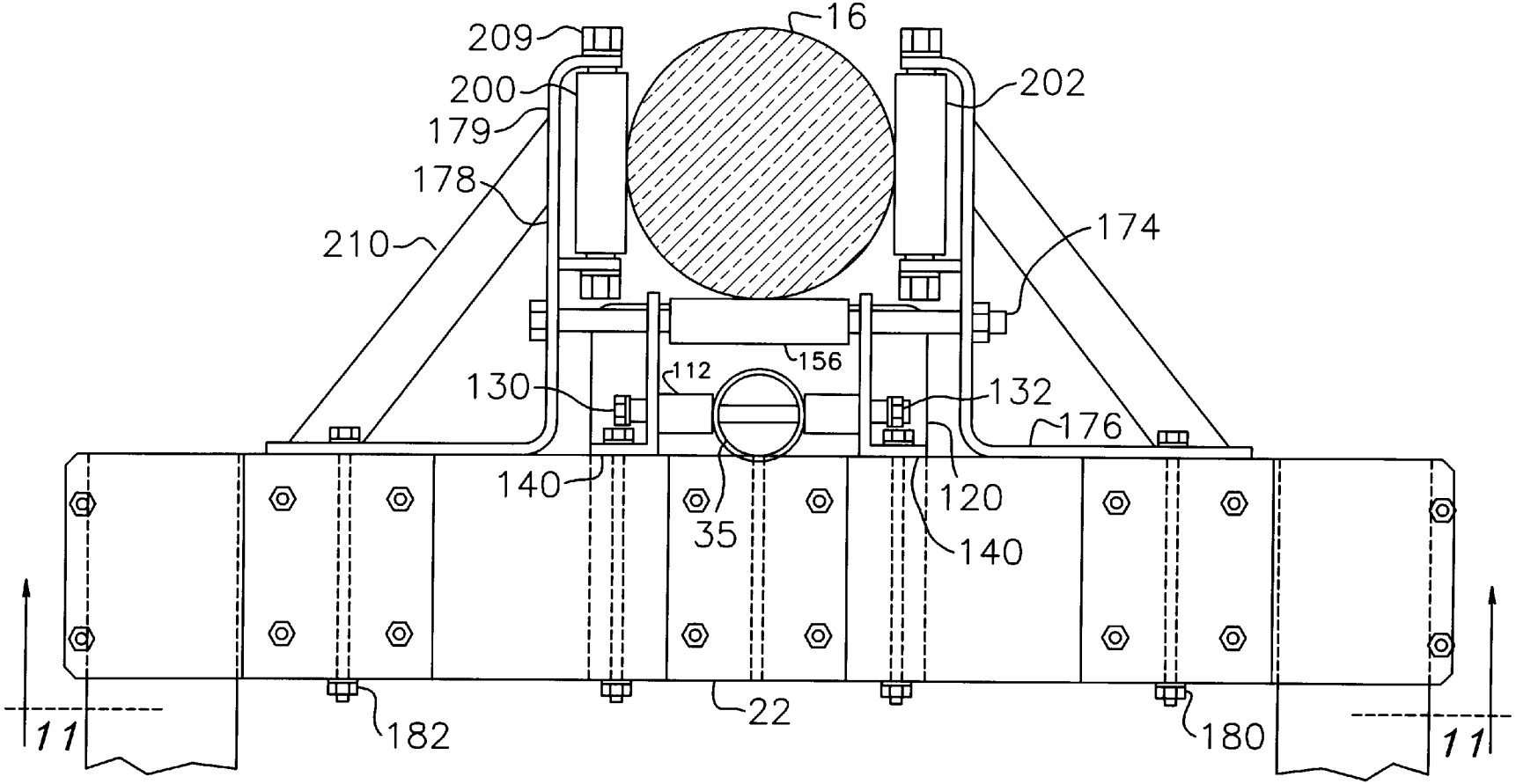
FIG. 10 is a cross sectional view taken along line 10—10 of FIG. 1.
Figure 11:
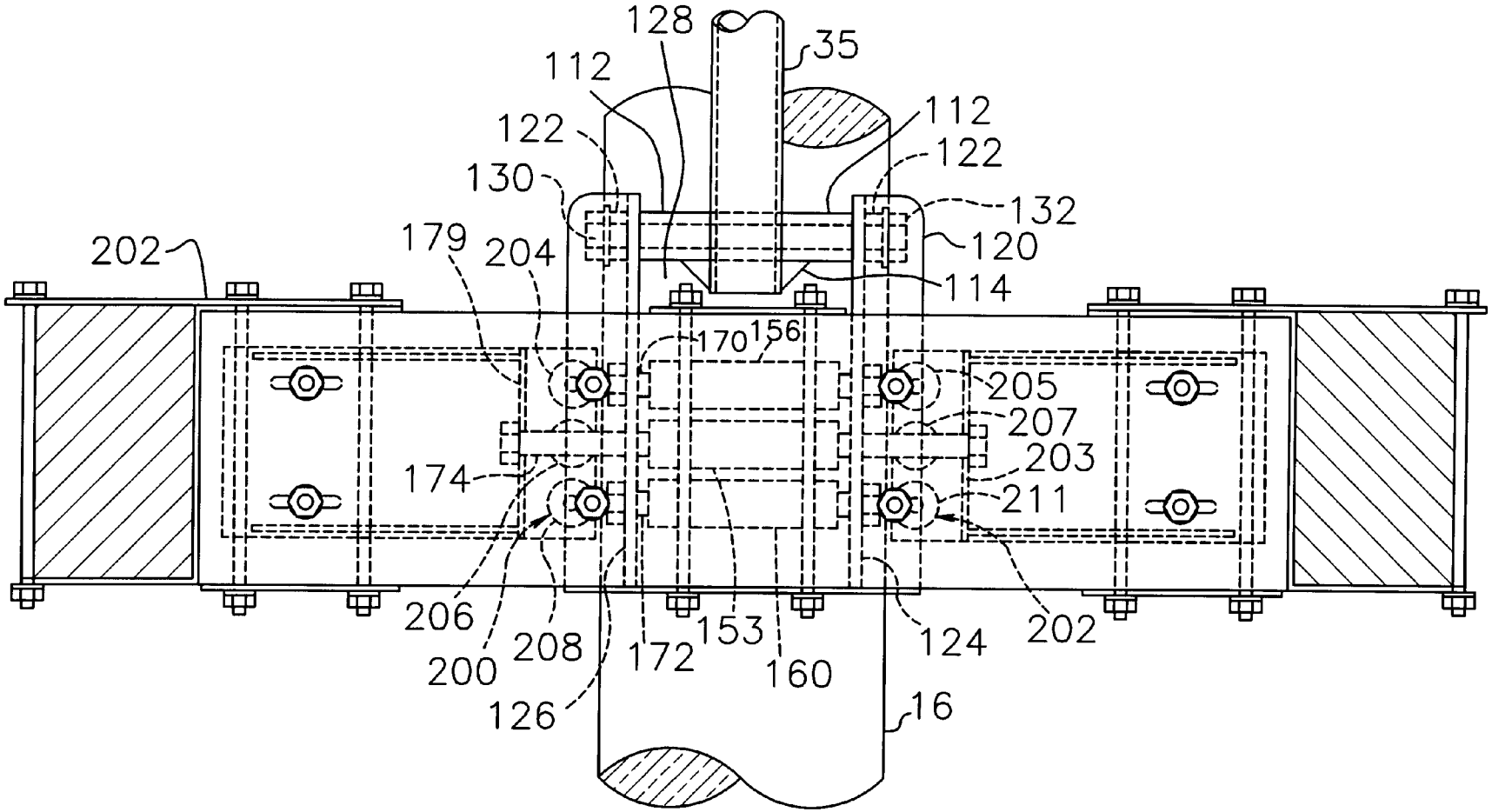
FIG. 11 is a cross sectional view of the lower end of the inner tube and the boat accommodating platform taken along line 11—11 of FIG. 10.
Figure 12:
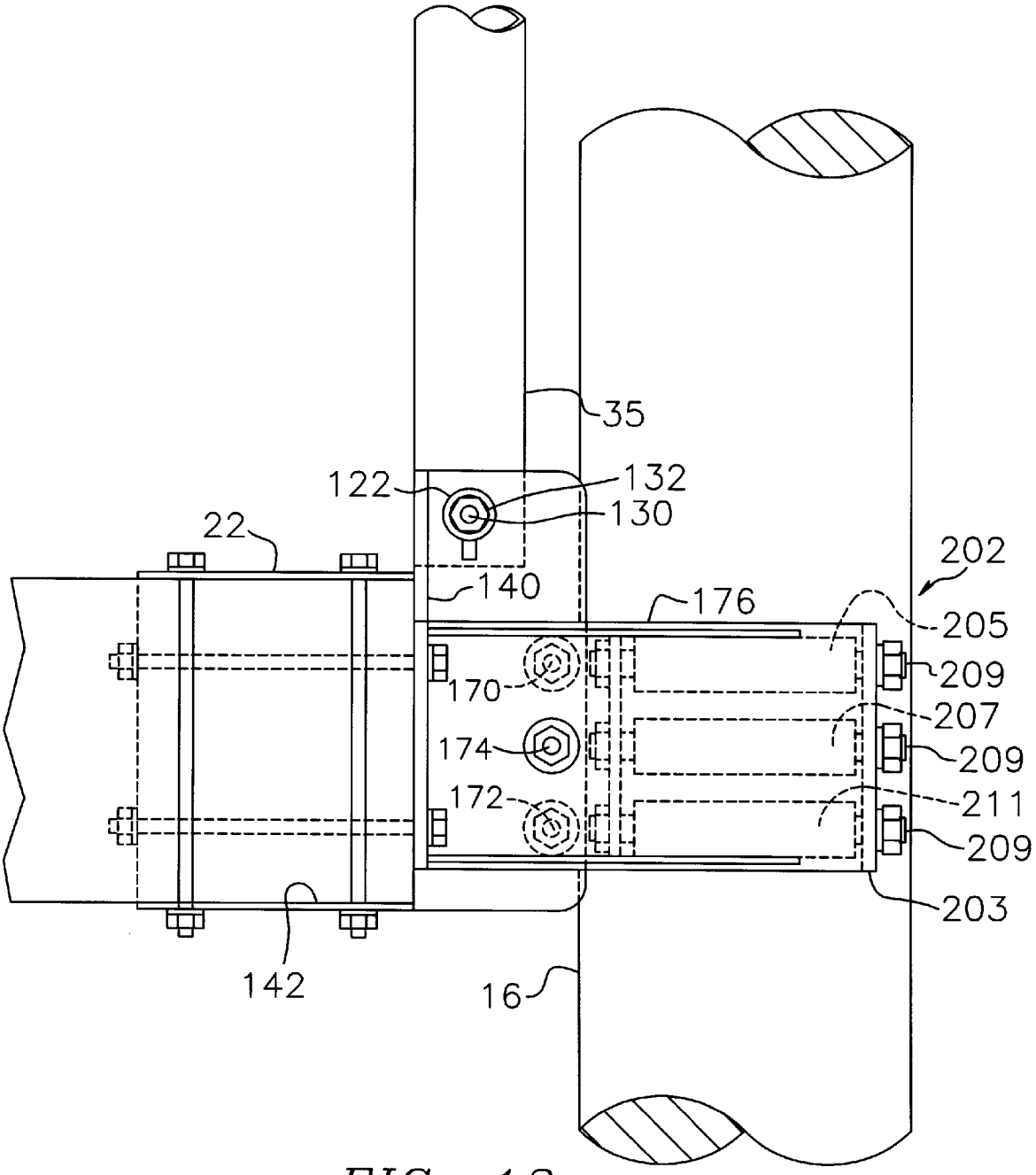
FIG. 12 is an elevational side view of the lower end of the inner tube and the interconnected boat accommodating platform.

The lower end of lift actuator assembly 20 is depicted in FIGS. 10, 11 and 12. The inner tube is pivotally connected to lift platform 22 by a bracket 120, shown alone in FIGS. 13, 14 and 15. Bushing 112 is aligned with threaded integral bushings 122 carried by bracket 120. These bushings are formed in depending members 124, 126 formed on either side of a bracket recess 128. As best shown in FIGS. 10–12, a threaded bolt 130 is inserted through bushing 112 and aligned bushings 122. A nut is attached to the bolt so that inner tube 35 is pivotally connected to bracket 120. As best shown in FIG. 11, the lower end of tube 35 and strengthening gussets 114 are received in recess 128 of bracket 120.

As shown in FIGS. 13–15, bracket 120 includes a pair of vertical segments 140 connected perpendicularly to depending members 124 and 126. A plate 142 is carried by segments 40 and members 124, 126. As illustrated in FIGS. 10–12, segments 140 engage the side surface of lift platform 22. Lower plate 142 supports the bottom surface of the platform. Platform 22 may comprise a conventional type of lift platform construction. More particularly, the platform may include various structural components composed of aluminum, wood, etc.

Members 124 and 126 of bracket 120 include corresponding roller mounting holes 150, 152 and 154, FIG. 13. Each pair of mounting holes rotatably supports a respective side roller 156, 158 and 160, FIGS. 10 and 11. As best shown in FIGS. 11 and 12, roller 156 is mounted on a pin 170 that extends between members 124 and 126. Similarly, roller 160 is axially mounted on a pin 172 that extends between members 124 and 126. The intermediate side roller 158 is mounted on a relatively long center pin 174 that is interconnected between L-shaped mounting arms 176 and 178 shown in FIG. 10. These L-shaped mounting arms are secured to the side of platform 22 by respective bolts 180 and 182.

The side rollers interengage the side of piling 16 that faces inwardly toward platform 22 and the boat mounted on the platform. As the platform is raised and lowered relative to the piling, the rollers engage the piling and guide the platform smoothly along the piling. When a pair of opposing actuator assemblies 20 are employed, as shown in FIG. 2, the side rollers 156, 158 and 160 help to prevent undesirable inward cantilevering of the pilings in the manner indicated by arrows 190 and 192. The rollers also prevent the lift platform from scuffing or binding against the piling and help to facilitate raising and lowering of the boat lift.

Lift 10 also employs forward and rearward guide roller assemblies 200 and 202, respectively. In particular, as shown in FIGS. 10 and 11, forward guide roller assembly 200 includes three guide rollers 204, 206 and 208 that are rotatably mounted to L-shaped mounting bracket 178 such that the axis of each roller is transverse to the longitudinal axis of platform 22. A yoke 179 is carried at the outer end of L-shaped bracket 178. A plurality of rollers 204, 206 and 208 are rotatably mounted in yoke 179 by respective pins 209. A pair of diagonal braces 210 interconnects the legs of L-shaped bracket 178 and help to strengthen the bracket. The upper brace is omitted from FIG. 10 for clarity. Similarly, a generally L-shaped rearward mounting bracket 176 carries roller assembly 202. In particular, a yoke 203 is carried at the distal end of bracket 176. Rollers 205, 207 and 211, best shown in FIGS. 11 and 12, are rotatably mounted in yoke 203 by respective pin assemblies 209.

The forward and rearward roller assemblies 200 and 202 help to guide the lift platform along pilings 16 and **16*a* and, in particular, constrain the platform so that it does not swing too far forward or rearward. The forward and rearward rollers serve as guides that adjust and compensate for misplacement of the boat on the lift platform 22. In particular, if the boat is placed too far forward or rearward, the forward and rearward roller guides 202 and 204** interengage the piling so that, as the lift platform is raised and lowered, the guide rollers counteract any undesirable moment that is exerted upon the lift by the mispositioned boat. Smooth and reliable operation of the lift mechanism is thereby achieved.

The present invention compensates for mispositioning in a much more efficient and effective manner than in prior art cable driven lifts. Known lifts typically require the use of four cables and attendant pulleys and motors to support an unbalanced vessel. In contrast, the present lift requires only two actuator assemblies on respective sides of the boat (FIG. 2). The shafts 30 feature far greater longitudinal stiffness than the heretofore used cables. Accordingly, one pair of actuator assemblies 20 adequately supports and balances the boat, even if the center of gravity is otherwise too far forward or rearward. The above-described roller assemblies 200,202 assist in this balancing.

In operation, drive motor 72 is driven in a first direction to raise the lift platform 22 and in an opposite, second direction to lower the lift platform. In the first direction, the pulley wheels of the reduction mechanism 74 are operated so that nut 64 turns in the first direction and at a speed that is less than the speed of the motor. This causes shaft 30, which is threadably engaged with screw 64, to be driven upwardly through the drive mechanism in the direction of arrow 70. The screw is pulled upwardly through lower tube 29, without rotating, and is introduced into upper receiver tube 32. Throughout the entire procedure, the threaded screw shaft remains enclosed in the aligned tubes and is thereby protected from salt water, foul weather and other causes of premature deterioration and corrosion. When the shaft is pulled upwardly in the direction of arrow 70, FIG. 3, the inner tube 35 is likewise pulled up into the lower guide tube 29. The inner and outer tubes slidably interengage along bearing 40, FIG. 3. Inner tube 35 pulls platform 22 upwardly in the direction of arrow 70, shown in FIG. 1 such that the lift platform is elevated from a submerged condition beneath water line 14 to the raised condition proximate dock 12 and shown in phantom.

To lower lift platform 22 and the boat supported thereon, motor 74 is driven in the opposite direction. As a result, the pulley wheels and associated belts are operated to rotate nut 64 in a direction that drives shaft 30 downwardly in the direction of arrow 73, FIG. 3. The shaft is not lowered by gravity. Rather, it is driven positively by the nut in a downward direction. The shaft is drawn downwardly from receiver tube 32, again without rotating, and is extended into lower guide tube 29. Inner tube 35 extends telescopically in a downward direction from tube 29. This lowers platform 22 in a positive manner until the platform is submerged beneath water line 14. The positive drive exhibited by the complementary nut and screw mechanism easily overcomes any buoyancy exerted by the water upon the lift platform. As a result, the boat is lowered reliably and safely into the water so that it can be satisfactorily deployed. Moreover, the use of a positive nut and screw drive mechanism eliminates the need for winches and cables. Accordingly, unintentional unraveling or tangling of the cables is eliminated. And, unlike conventional winch mechanisms, the lift does not rely on gravity to lower the lift platform. The lift platform and boat do not free-fall. Additionally, the lift does not require intricate and expensive braking mechanisms.

The roller guides and pivotable interconnection between inner tube 35 and the platform 22 provide additional benefits. Specifically, the pivot pin 130 that interconnects inner tube 35 and bracket 120 enables the entire platform 22 to pivot slightly relative to the inner tube and actuator assembly 20. This permits the lift to compensate for a lack of synchronization between the drive motors on opposing pilings 16 and 16*a*. In such cases, one side of the platform may be raised slightly higher than the opposite side. Pivots 130 allows the platform to be raised at a slight side-to-side angle without disrupting the operation of lift 10.

The side, forward and rearward rollers constrain movement of the lift platform relative to the pilings in the manner described above. As a result, a smoother and more reliable operation is achieved.

As previously indicated, the lift may be operated using either one, two or four actuators assemblies 20. One actuator assembly is typically used for personal watercraft and other small vessels. Larger boats usually require two or more actuator assemblies on opposite sides of the vessel, as shown in FIG. 2. It should also be understood that, in alternative embodiments, the shaft may be rotatably suspended from a drive mechanism and the nut may be fixed to the lift platform. In such versions the shaft is rotated through the nut such that the platform is selectively raised and lowered. In either event, relative rotation between the threadably interengaged nut and shaft positively drives the lift platform and the vessel supported thereon.

The pilings 16, 16*a* serve a critical function in lift 10. Not only do they bear the force or load of the lift, they also serve to guide the lift platform as it travels up and down.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A boat lift apparatus comprising:

a support structure located proximate to a body of water;

an elongate, threaded shaft located adjacent said support structure and extending in a substantially vertical direction;

a nut that threadably engages said shaft;

a boat accommodating platform;

means for attaching said platform and said shaft;

means for rotatably mounting said nut to said support structure and selectively driving said nut rotatably in a first direction to raise said shaft relative to said nut and in an opposite, second direction to lower said shaft relative to said nut, whereby said platform and a boat accommodated thereon are selectively lifted and lowered relative to the body of water; and tubular guide means mounted to said support structure for accommodating said shaft as said shaft is raised and lowered; said means for attaching including an elongate element that is interconnected between said shaft and said platform, said elongate element being retracted into said tubular guide means when said shaft is raised and extended below said tubular guide means when said shaft is lowered.

2. The apparatus of claim 1 in which said means for mounting and driving include a wheel rotatably mounted on said support structure, said nut being generally surrounded by and mounted axially in said wheel, said means for mounting and driving further including means for selectively turning said wheel in opposing first and second directions to respectively raise and lower said shaft relative to said nut.

3. The apparatus of claim 2 in which said nut is defined by a threaded opening formed axially through said wheel.

4. The apparatus of claim 2 in which said means for mounting and driving include a drive motor and means for operably interengaging said drive motor and said nut.

5. The apparatus of claim 4 in which said means for operably interengaging include reduction means for transferring rotation from said motor to said nut and controlling the rotational speed of said nut.

6. The apparatus of claim 5 in which said reduction means include a pulley assembly.

7. The apparatus of claim 6 in which said pulley assembly includes a primary pulley wheel, said nut being surrounded by and axially mounted in said primary pulley wheel.

8. The apparatus of claim 1 in which said elongate element includes an inner tubular member that is received generally telescopically within said tubular guide means.

9. The apparatus of claim 1 in which said guide means include a lower guide tube that is suspended from said support structure and is located beneath said nut.

10. The apparatus of claim 1 in which said guide means include an upper guide tube carried by said support structure and located above said nut.

11. The apparatus of claim 1 further including a generally tubular bearing sleeve carried by an interior surface of said guide means and slidably interengaging said tubular member when said inner tubular member is moved retractably or extendably relative to said guide means.

12. The apparatus of claim 1 in which said means for attaching include means for pivotably interconnecting said elongate shaft to said platform.

13. A boat lift apparatus comprising:

a pair of support pilings located proximate a body of water on respective sides of a boat;

a boat accommodating platform; and a pair of actuator assemblies, each including an elongate, threaded shaft disposed adjacent to a respective one of said pilings and extending in a substantially vertical direction, a nut that threadably engages said shaft, one of said shaft and said nut being attached to said platform, and means for rotatably mounting the other of said shaft and said nut to said respective support piling such that said respective support piling is longitudinally compressively loaded by said lift apparatus and a boat accommodated on said platform and for selectively driving said shaft and said nut rotatably relative to one another in a first direction to raise said shaft relative to said nut and in an opposite, second direction to lower said shaft relative to said nut, whereby said platform and a boat accommodated thereon are selectively lifted and lowered by said actuator assemblies relative to the body of water.

14. The apparatus of claim 13 further including guide means mounted to said platform for interengaging said pilings and constraining the position of said platform relative to said pilings when said platform is lifted and lowered.

15. The apparatus of claim 14 in which said guide means include a rotatable side roller assembly arranged axially parallel to a longitudinal axis of said platform and interengagable with said pilings to resist inward cantilevering of said pilings relative to one another.

16. The apparatus of claim 14 in which said guide means include spaced apart forward and rearward roller assemblies arranged axially transverse to a longitudinal axis of said platform and interengagable respectively with forwardly and rearwardly facing surfaces of said pilings.

17. The apparatus of claim 13 in which said means for attaching include means for pivotally interconnecting each said elongate shaft to said platform.

18. A boat lift apparatus for use in combination with a substantially vertical support piling located proximate a body of water, said apparatus comprising:

an elongate, threaded shaft disposed adjacent to the piling and extending in a substantially vertical direction;

a nut that threadably engages said shaft;

a boat accommodating platform attached to one of said shaft and said nut; and means for rotatably mounting the other of said shaft and said nut to the support piling such that the support piling is longitudinally compressively loaded by said lift apparatus and a boat accommodated on said platform, and for selectively driving said shaft and said nut rotatably relative to one another in a first direction to raise said shaft relative to said nut and in an opposite, second direction, to lower said shaft relative to said nut, whereby said platform and a boat accommodated thereon are selectively lifted and lowered relative to the body of water.

19. A boat lift apparatus comprising:

a vertical support structure disposed in and extending above a body of water;

an elongate, threaded shaft disposed adjacent to said support structure and extending in a substantially vertical direction;

a nut that threadably engages said shaft;

a boat accommodating platform attached to one of said shaft and said nut; and means for rotatably mounting the other of said shaft and said nut to said support structure such that said support structure is compressively loaded by said lift apparatus and a boat accommodated on said platform, and for selectively driving said shaft and said nut rotatably relative to one another in a first direction to raise said shaft relative to said nut and in an opposite, second direction, to lower said shaft relative to said nut, whereby said platform and the boat accommodated thereon are selectively lifted and lowered relative to the body of water.

20. The apparatus of claim 19 in which said support structure includes a piling.

21. The apparatus of claim 19 in which said threaded shaft includes an acme screw thread.

22. The apparatus of claim 19 further including guide means mounted to said platform for interengaging said support structure and constraining the position of said platform relative to said support structure when said platform is lifted and lowered.

23. The apparatus of claim 22 in which said guide means include a rotatable side roller assembly arranged axially parallel to a longitudinal axis of said platform and interengagable with a side of said support structure that faces said platform.

24. The apparatus of claim 22 in which said guide means include spaced apart forward and rearward roller assemblies arranged axially transverse to a longitudinal axis of said platform and interengagable respectively with forwardly and rearwardly facing surfaces of said support structure.

25. The apparatus of claim 19 further including means mounted to said platform for interengaging said support structure and constraining the position of said platform relative to said support structure when said platform is lifted and lowered.

26. The apparatus of claim 25 in which said guide means include a rotatable side roller assembly arranged axially parallel to a longitudinal axis of said platform and interengagable with a side of said support structure that faces said platform.

27. The apparatus of claim 25 in which said guide means include spaced apart forward and rearward roller assemblies arranged axially transverse to a longitudinal axis of said platform and interengagable respectively with forwardly and rearwardly facing surfaces of said support structure.

28. A boat lift apparatus for use in combination with a vertical support structure disposed in and extending above a body of water, said apparatus comprising;

an elongate, threaded shaft disposed adjacent to the support structure and extending in a substantially vertical direction;

a nut that threadably engages said shaft;

a boat accommodating platform attached to one of said shaft and said nut;

means for rotatably mounting the other of said shaft and said nut to said support structure, and for selectively driving said shaft and said nut rotatably relative to one another in a first direction to raise said shaft relative to said nut and in an opposite, second direction, to lower said shaft relative to said nut, whereby said platform and a boat accommodated thereon are selectively lifted and lowered relative to the body of water; and a guide attached to the support structure, which guide permanently and fully encloses said shaft to protect said shaft against deterioration.

29. The apparatus of claim 28 wherein said means for mounting include means for engaging the other of said shaft and said nut with said support structure such that said support structure is compressively loaded by the lift apparatus and a boat accommodated on said platform.

* * * * *